US007686353B2

(12) United States Patent
Lewis et al.

(10) Patent No.: US 7,686,353 B2
(45) Date of Patent: Mar. 30, 2010

(54) CABINET CATCH FOR USE IN A CABINET LATCH ASSEMBLY AND A METHOD FOR MAKING THE CATCH

(75) Inventors: Jeffery C. Lewis, Rochester, MI (US); Thomas E. Blake, III, South Lyon, MI (US)

(73) Assignee: TRW Automotive U.S. LLC, Livonia, MI (US)

( * ) Notice: Subject to any disclaimer, the term of this patent is extended or adjusted under 35 U.S.C. 154(b) by 988 days.

(21) Appl. No.: 10/819,877

(22) Filed: Apr. 7, 2004

(65) Prior Publication Data

US 2005/0225094 A1 Oct. 13, 2005

(51) Int. Cl.
*E05C 19/02* (2006.01)
*E05C 19/00* (2006.01)

(52) U.S. Cl. ..... 292/19; 292/80; 292/87; 292/DIG. 38; 16/82

(58) Field of Classification Search ..... 292/19, 292/76, 80, 87, 88, 249, DIG. 15, DIG. 38; 16/82, 85, 86 B, DIG. 17; 24/457, 530, 545, 24/662

See application file for complete search history.

(56) References Cited

U.S. PATENT DOCUMENTS

| | | | | | |
|---|---|---|---|---|---|
| 389,605 | A | * | 9/1888 | Shaw | 292/17 |
| 504,142 | A | * | 8/1893 | Wilburn | 292/17 |
| 548,501 | A | * | 10/1895 | Barbarow | 292/17 |
| 1,089,193 | A | * | 3/1914 | Ervien | 292/15 |
| 2,079,648 | A | * | 5/1937 | Aldeen et al. | 292/17 |
| 2,092,508 | A | * | 9/1937 | Hammar | 40/620 |
| 2,244,344 | A | * | 6/1941 | North et al. | 292/18 |
| 2,493,624 | A | * | 1/1950 | Gerson | 292/17 |
| 2,793,891 | A | * | 5/1957 | Frye | 292/18 |
| 3,061,346 | A | * | 10/1962 | Jorgensen | 292/17 |
| 3,086,803 | A | * | 4/1963 | Wilson | 292/17 |
| 3,103,378 | A | * | 9/1963 | Ahlgren | 292/17 |
| 3,734,551 | A | * | 5/1973 | Hughes et al. | 292/17 |
| 4,056,275 | A | * | 11/1977 | Keeler, II | 292/17 |
| 4,250,599 | A | * | 2/1981 | Nagashima et al. | 24/326 |
| 4,566,660 | A | * | 1/1986 | Anscher et al. | 248/74.2 |
| 4,657,291 | A | * | 4/1987 | Kurosaki | 292/6 |
| 4,660,871 | A | * | 4/1987 | Arakawa et al. | 292/81 |
| 4,701,983 | A | * | 10/1987 | Warmath | 24/511 |
| 4,706,917 | A | * | 11/1987 | Thalenfeld | 248/205.1 |
| 4,709,949 | A | * | 12/1987 | Umezawa et al. | 292/6 |
| 4,765,036 | A | * | 8/1988 | Iguchi et al. | 24/289 |
| 4,878,276 | A | * | 11/1989 | Morrish et al. | 24/511 |

(Continued)

*Primary Examiner*—Brian E. Glessner
*Assistant Examiner*—Carlos Lugo
(74) *Attorney, Agent, or Firm*—Tarolli, Sundheim, Covell & Tummino LLP

(57) ABSTRACT

A cabinet catch (10) consists of an integrally molded plastic clip (14) and bracket (12) for mounting to a portion of a cabinet structure. The clip (14) is manufactured from a first plastic material. The clip (14) is rotatable relative to the bracket (12) about an axis of rotation (20). The bracket (12) is formed from a second plastic material different from the first material. The first and second plastic materials are dissimilar to each other so they do not bond to each other. A method of manufacturing the cabinet catch (10) includes the steps of injection molding the clip (14) with a first plastic material and then injection molding the bracket (12) with a second plastic material different from the first plastic material so that the clip and the bracket (12) are integrally molded.

8 Claims, 6 Drawing Sheets

U.S. PATENT DOCUMENTS 4,881,764 A * 11/1989 Takahashi et al. ..... 292/13
5,335,838 A * 8/1994 Harris et al. ..... 227/132
5,445,451 A * 8/1995 Harmony ..... 312/333
5,454,931 A * 10/1995 Lauve, Jr. ..... 206/317
5,606,771 A * 3/1997 Young ..... 16/90
5,645,304 A * 7/1997 Richardson et al. ..... 292/1
5,647,618 A * 7/1997 Lamberth ..... 292/19
5,683,158 A * 11/1997 Lim ..... 312/326
5,711,554 A * 1/1998 Brown et al. ..... 292/19
6,942,257 B2 * 9/2005 Wong et al. ..... 292/128

* cited by examiner

CABINET CATCH FOR USE IN A CABINET LATCH ASSEMBLY AND A METHOD FOR MAKING THE CATCH

TECHNICAL FIELD

The present invention relates to a cabinet catch for use in a cabinet latch assembly, and to a method for making the cabinet catch.

BACKGROUND OF THE INVENTION

A cabinet is a cupboard-like compartment fitted with shelves or drawers for storing articles and is usually closed by a hinged door. It is desirable to prevent the cabinet door when closed from easily opening to prevent the contents of the cabinet from falling out, especially if the cabinet is located in a movable structure such as a camper or a boat. A closed cabinet door can be releasably secured to the cabinet by a cabinet latch assembly.

A known type of cabinet latch assembly consists of a catch and a latch for securing to the catch. The catch is a nine-component assembly. The time to assemble a nine-component cabinet catch is lengthy because of the large number of components. There is a need for a cabinet catch which consists of a minimum number of components to shorten manufacturing time, reduce assembly time, reduce assembly cost and improve reliability of operation.

SUMMARY OF THE INVENTION

A cabinet catch consists of a molded plastic bracket for mounting to a portion of a cabinet structure. The clip is manufactured from a first plastic material. A plastic bracket is integrally molded with the clip. The clip is rotatable relative to the bracket about an axis of rotation. The bracket is formed from a second plastic material different from the first plastic material. The first and second plastic materials are dissimilar to each other so that they do not bond to each other.

A method of manufacturing the cabinet catch includes the steps of injection molding the clip of a first plastic material and then injection molding the bracket with a second plastic material different from the first plastic material so that the clip and bracket are integrally molded together.

BRIEF DESCRIPTION OF THE DRAWINGS

The foregoing and other features of the present invention will become apparent to those skilled in the art to which the present invention relates upon reading the following description with reference to the accompanying drawings, in which.

DESCRIPTION OF THE INVENTION

Figure 1:
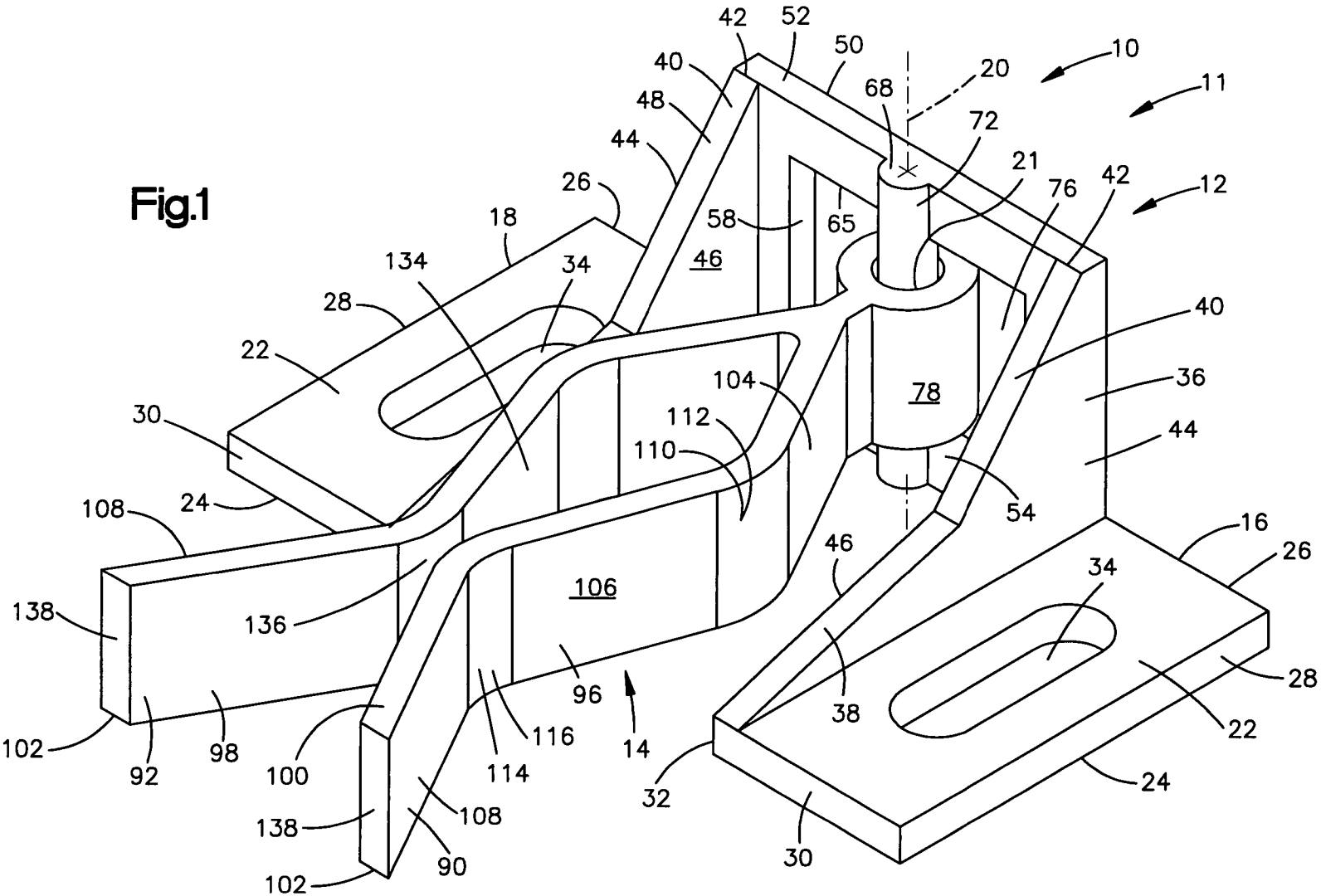
FIG. 1 is a perspective view of an assembled cabinet catch embodying the present invention.

FIG. 1 shows a perspective view of the cabinet catch 10 of the invention. The cabinet catch 10 is a component of a cabinet latch assembly 11 used to releasably secure a cabinet door to a cabinet structure. The cabinet catch 10 is an integrally molded plastic structure. The cabinet catch 10 consists of a bracket 12 and a clip 14.

The bracket 12 (FIGS. 1 and 2) includes first and second spaced apart legs 16, 18. The first leg 16 has a generally rectangular shape. The length of the first leg 16 is longer than its width. The first leg 16 has a top surface 22, a bottom surface 24 and four side surfaces 26, 28, 30, 32 which are located between and which interconnect the top and bottom surfaces in an overlying and spaced apart relationship. The side surfaces 26, 28, 30, 32 define the thickness of the first leg 16.

The first leg 16 defines an elongated slot 34 having a generally oval shape. The slot 34 has a length which is longer than its width. The length of the slot 34 is shorter than the length of the first leg 16. The width of the slot 34 is shorter than the width of the first leg 16. The slot 34 is located approximately in the center of the first leg 16. The slot 34 is for receiving a fastener (FIG. 3) for mounting the bracket 12 to the cabinet structure, as discussed in more detail below.

The second leg 18 is a mirror image of the first leg 16 and as such the same reference numerals are used to identify the parts of the second leg that were used with regard to the first leg. The second leg 18 has a generally rectangular shape. The length of the second leg 18 is longer than its width. The second leg 18 has a top surface 22, a bottom surface 24, and four side surfaces 26, 28, 30, 32 which are located between and which interconnect the top and bottom surfaces in an overlying and spaced apart relationship. The side surfaces 26, 28, 30, 32 define the thickness of the second leg 18.

The second leg 18 defines an elongated slot 34 having a generally oval shape. The slot 34 has a length which is longer than its width. The length of the slot 34 is shorter than the length of the second leg 18. The width of the slot 34 is shorter than the width of the second leg 18. The slot 34 is located approximately in the center of the second leg 18.

The bracket 12 includes a first side wall 36 extending perpendicularly from the top surface 22 of the first leg 16 at a location adjacent to side surface 32. The first side wall 36 has a length which is equal to the length of the first leg 16. The first side wall 36 has a first sloped surface 38 and a second sloped surface 40. The first sloped surface 38 slopes upward away from the top surface 22 of the first leg 16 at an angle of approximately 25-35° relative to the top surface of the first leg. The second sloped surface 40 extends from the first sloped surface 38 to an end point 42. The angle of the second sloped surface 40 is approximately 65-70° relative to the top surface 22 of the first leg 16.

The first side wall 36 includes a front surface 44 and a back surface 46. The front and back surfaces 44, 46 extend perpendicularly upward (as viewed in FIGS. 1 and 2) from the top surface 22 of the first leg 16. The first and second sloped surfaces 38, 40 interconnect the front and back surfaces 44, 46 of the first side wall 36 in an overlying and spaced apart relationship.

The first and second sloped surfaces 38, 40 define a thickness of the first side wall 36 which is approximately equal to the thickness of the first leg 16. The height of the first side wall 36 varies along the length of the first side wall. The height of the first side wall 36 is smallest at the first sloped surface 38 bordering the top surface 22. The height of the first side wall 36 gradually increases and is greatest at the end point 42 of the second sloped surface 40.

The bracket 12 includes a second side wall 48. The second side wall 48 is a mirror image of the first side wall 36 and as such the same reference numerals are used to identify the parts of the second side wall that were used with regard to the first side wall. The second side wall 48 extends perpendicularly from the top surface 22 of the second leg 18 at a location adjacent the side surface 32. The second side wall 48 has a length which is equal to the length of the second leg 18.

The second side wall 48 has a first sloped surface 38 and a second sloped surface 40. The first sloped surface 38 slopes upward away from the top surface 22 of the second leg 18 at an angle of approximately 25-35° relative to the top surface of the second leg. The second sloped surface 40 extends from the first sloped surface 38 to an end point 42. The angle of the second sloped surface 40 is approximately 65-70° relative to the top surface 22 of the second leg 18.

The second side wall 48 includes a front surface 44 and a back surface 46. The front and back surfaces 44, 46 extend perpendicularly and upward (as viewed in FIGS. 1 and 2) from the top surface 22 of the second leg 18. The first and second sloped surfaces 38, 40 are between and interconnect the front and back surfaces 44, 46 of the second side wall 48 in an overlying and spaced apart relationship.

The first and second sloped surfaces 38, 40 define a thickness of the second side wall 48 which is approximately equal to the thickness of the second leg 18. The height of the second side wall 48 varies along the length of the second side wall. The height of the second side wall 48 is smallest at the first sloped surface 38 bordering the top surface 22. The height of the second side wall 48 gradually increases and is tallest at the end point 42 of the second sloped surface 40.

The bracket 12 includes a back wall 50. The back wall 50 interconnects the first and second side walls 36, 48 in a spaced apart relationship. The back wall 50 has a generally square shape. The back wall 50 is configured as a frame having a top border 52 and a bottom border 54 interconnected by first and second side borders 56, 58. The four borders define a central opening 76 of the back wall 50.

The first side border 56 extends perpendicularly from the back surface 46 of the first side wall 36 and from the side wall 32 of the first leg 16. The first side border 56 has a surface (not shown) defining the thickness of the first side border. The first side border 56 has a height which is taller than its width. The height of the first side border 56 is equal to the sum of the height of the first side wall 36 plus the height of the side wall 32 of the first leg 16. The first side border 56 extends generally vertically as viewed in FIG. 1.

The second side border 58 extends perpendicularly from the back surface 46 of the second side wall 48 and from the side wall 32 on the second leg 18. The second side border 58 has a surface 62 (FIG. 2) defining the thickness of the second side border. The second side border 58 has a height which is taller than its width. The height of the second side border 58 is equal to the sum of the height of the second side wall 48 plus the height of the side wall 32 of the second leg 18. The second side border 58 extends generally vertically as viewed in FIG. 1, parallel to the first side border 56.

The top border 52 extends between upper end portions of the first and second side borders 56, 58. The bottom border 54 extends between lower end portions of the first and second side borders 56, 58. The top and bottom borders 52, 54 also have surfaces 64 and 65 which define the thickness of the top and bottom borders.

A solid cylindrical body 68 extends between the top and bottom borders 52, 54 of the back wall 50, at a location centered laterally in the central opening 76. The cylindrical body 68 is formed as one piece with and interconnects the top and bottom borders 52, 54. The diameter of the cylindrical body 68 is greater than the thickness of the top and bottom borders 52, 54. A vertical axis of rotation 20 extends through an opening 21 in the center of the cylindrical body 68. The legs 16, 18 extend perpendicularly to the vertical axis of rotation 20.

The cylindrical body 68 has an upper end portion 72 which interconnects with the top border 52. At this interconnecting upper end portion 72, half of the cylindrical body 68 protrudes outward from the top border 52 in the direction away from the back wall 50. Similarly, the cylindrical body 68 has a lower end portion 74 which interconnects with the bottom border 54. At this interconnecting lower end portion 74, half of the cylindrical body 68 protrudes outward from the bottom border 54 in the direction away from the back wall 50.

The bracket 12 is formed as one piece, preferably molded, so that all the surfaces of the bracket are continuous with one another. The overall size of the bracket 12 is within the range of one-quarter to three-quarter inches long and one-half to one and one-quarter inches wide.

The clip 14 (FIGS. 1 and 2A) is integrally molded with the bracket 12. The clip 14 has an overall oblong shape. The clip 14 has a head portion which is a hollow cylindrical member 78 which surrounds the solid cylindrical body 68 of the bracket 12 and is rotatable relative thereto. The clip 14 is rotatable relative to the bracket 12 about the vertical axis of rotation 20. The length, diameter and height of the hollow cylindrical member 78 are selected so that the member 78 fits within the central opening 76.

A neck portion or protrusion 80 of the clip 14 protrudes from the outer surface of the hollow cylindrical member 78 in a direction away from the back wall 50 and between the first and second side walls 36, 48. The neck portion 80 has first and second side surfaces 82, 84, a top surface 86, and a bottom surface (not shown). The height of the neck portion 80 is identical to the height of the hollow cylindrical member 78. The width of the neck portion 80 is considerably less than the diameter of the hollow cylindrical member 78. The width of the neck portion 80 is approximately the same as the thickness of the first and second legs 16, 18 of the bracket 12. The neck portion 80 extends only a small length from the outer surface of the hollow cylindrical member 78. The length of the neck portion 80 is approximately equal to its width.

The clip 14 has first and second flexible arms 90, 92 that extend from the neck portion 80. The arms 90 and 92 have first end portions 94 that are joined together at the neck portion 80.

The height of the first arm 90 is equal to the height of the neck portion 80. The thickness of the first arm 90 is equal to the thickness of the neck portion 80. The length of the first arm 90 is approximately one and one-half times the length of the bracket 12.

The first arm 90 has an outer surface 96 and an inner surface 98 overlying the outer surface. The first arm 90 has top and bottom surfaces 100, 102 which are located between and interconnect the outer and inner surfaces 96, 98 in an overlying and spaced apart relationship.

The first arm 90 has a zigzag or flattened Z-shaped configuration. The outer surface 96 of the first arm includes three continuous surface portions 104, 106, 108. When viewed in FIG. 2A, the first arm 90 of the vertically extending clip 14 has a first surface portion 104 which extends from the first end 94 in the direction diagonally downward and to the right. A second surface portion 106 extends from the first surface portion 104 in the direction diagonally downward and to the left. A third surface portion 108 extends from the second surface portion 106 and in the direction diagonally downward and to the right.

The first and second surface portions 104, 106 of the outer surface 96 of the first arm 90 define a first arched portion 110 of the first arm 90. The first arched portion 110 has a first apex 112 cambered in a first direction. As viewed in FIG. 1 showing the clip molded integrally with the bracket 12, the first apex 112 faces in the first direction which is towards the back surface 46 of the first side wall 36. The second and third surface portions 106, 108 of the outer surface 96 of the first arm 90 define a second arched portion 114 of the first arm 90. The second arched portion 114 has a second apex 116 cambered in a second direction. The second apex 116 faces in the second direction which is opposite the first direction and is towards the back surface 46 of the second side wall 48.

Similarly, the inner surface 98 of the first arm 90 comprises three continuous surface portions 120, 122, 124. When viewed in FIG. 2A, the inner surface 98 of the first arm 90 of the vertically extending clip 14 has a first surface portion 120 which extends from the first end 94 in the direction diagonally downward and to the right. A second surface portion 122 extends from the first surface portion 120 in the direction diagonally downward and to the left. A third surface portion 124 extends from the second surface portion 122 and in the direction diagonally downward and to the right.

The first and second surface portions 120, 122 of the inner surface 98 define a first arched portion 126 of the first arm 90. The first arched portion 126 has an apex 128 which is cambered in the first direction. As viewed in FIG. 1, the apex 128 faces in the first direction. The second and third surface portions 122, 124 define a second arched portion 130 of the first arm 90. The second arched portion 130 has an apex 132 which is cambered in the second direction. The first and second arched portions 110, 114, 126, 130 of the outer and inner surfaces 96, 98 overlie each other.

The second arm 92 is a mirror image of the first arm 90 and as such the same reference numerals are used to identify the parts of the second arm that were used with regard to the first arm. The height, the thickness, and the length of the second arm 92 is equal to the height, the thickness, and the length of the first arm 90.

The second arm 92 has an outer surface 96 and an inner surface 98 overlying the outer surface. The second arm 92 has top and bottom surfaces 100, 102 which are located between and interconnect the outer and inner surfaces 96, 98 in an overlying and spaced apart relationship.

The second arm 92 has a zigzag or Z-shaped configuration in a pattern opposite the first arm 90. The outer surface 96 of the second arm 92 includes three continuous surface portions 104, 106, 108. When viewed in FIG. 2A, the second arm 92 of the vertically extending clip 14 has a first surface portion 104 which extends from the first end 94 in the direction diagonally downward and to the left. A second surface portion 106 extends from the first surface portion 104 in the direction diagonally downward and to the right. A third surface portion 108 extends from the second surface portion 106 and in the direction diagonally downward and to the left.

As viewed in FIG. 1, the first and second surface portions 104, 106 of the outer surface 96 of the second arm 92 define a first arched portion 110 of the second arm 92. The first arched portion 110 has an apex 112 cambered in the second direction. The second and third surface portions 106, 108 of the outer surface 96 of the second arm 92 define a second arched portion 114 of the second arm 92. The second arched portion 114 has an apex 116 cambered in the first direction.

Similarly, the inner surface 98 of the second arm 92 includes three continuous surface portions 120, 122, 124. When viewed in FIG. 2A, the inner surface 98 of the second arm 92 of the vertically extending clip 14 has a first surface portion 120 which extends from the first end 94 in the direction diagonally downward and to the left. A second surface portion 122 extends from the first surface portion 120 in the direction diagonally downward and to the right. A third surface portion 124 extends from the second surface portion 122 and in the direction diagonally and to the left.

The first and second surface portions 120, 122 define a first arched portion 126 of the second arm 92. The first arched portion 126 has an apex 128 cambered in the second direction. The second and third surface portions 122, 124 define a second arched portion 130 of the second arm 92. The second arched portion 130 has an apex 132 cambered in the first direction. The first and second arched portions 110, 114, 126, 130 of the outer and inner surfaces 96, 98 of the second arm 92 overlie each other.

The first and second surface portions 120, 122 of the inner surfaces 98 of the first and second arms 90, 92 define a diamond shaped cavity 134. The cavity 134 has an opening or entrance 136 defined by the second apexes 132, the third surface portions 124 of the inner surfaces 98, and the end points 138 of the first and second arms 90, 92.

Figures 2, 2A, 2B:
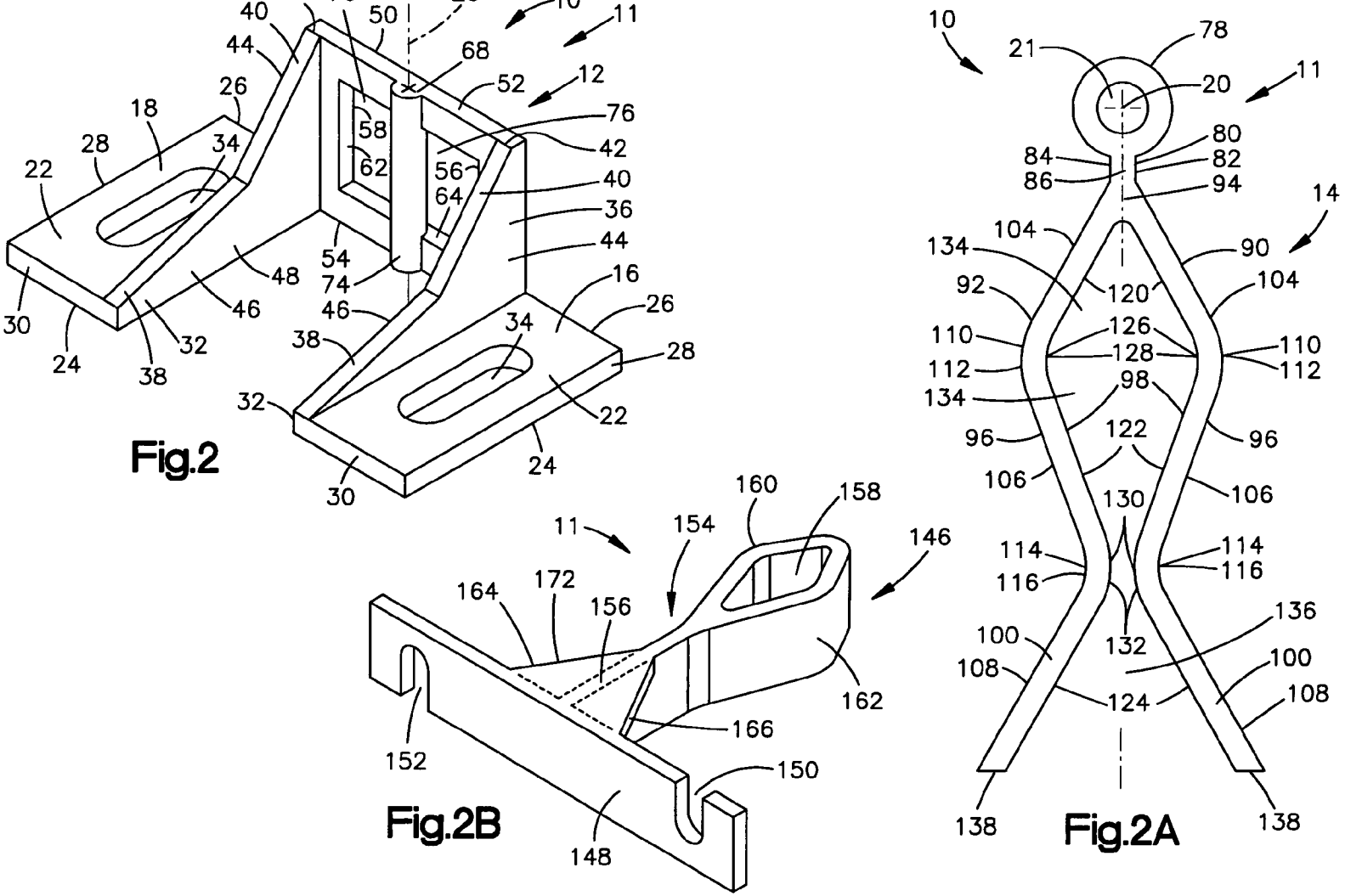
FIG. 2 is a perspective view of a portion of the cabinet catch embodying the present invention.
FIG. 2A is a plan view of another portion of the cabinet catch embodying the present invention.
FIG. 2B is a perspective view of still another portion of the cabinet catch embodying the present invention.

The clip 14 is made from a resilient material so that the arms 90 and 92 of the clip 14 are resilient. When the clip 14 is in a free condition as shown in FIGS. 1 and 2A the arms are separated by a small distance between the apexes 132. The arms 90 and 92 can be spread apart from each other in response to a force exceeding a predetermined force, and will thereafter resiliently return to the free condition shown in FIGS. 1 and 2A.

The overall size of the clip 14 is one to one and one-half inches long and one-quarter to one-half inches wide. In the embodiment shown in FIG. 1, the clip 14 is made of a plastic material known in the art as POM, a.k.a. polyoxymethylene or Acetal. The bracket 12 is made of a nylon known in the art as PA6, a.k.a. Polyamide (nylon) 6. As described below in detail, POM and PA6 are dissimilar materials in that they have different properties making them difficult to bond to one another without adhesive.

Instead of the clip 14 being made from POM, the clip can be made from another suitable material. Other suitable materials include but are not limited to polycarbonate, polypropylene, ABS a.k.a. Acrylonitrile Butadiene Styrene or a blend of polycarbonate and ABS. Instead of the bracket 12 being made from PA6, the bracket can be made from another suitable material. Other suitable materials include but are not limited to PA66, a.k.a. Polyamide (nylon) 66 or PBT, a.k.a. Polybutylene Terephthalate. The group of materials used to make the clip 14 can be wholly interchanged with the group of materials used to make the bracket 12.

The cabinet latch assembly 11 also includes a cabinet latch 146 (FIG. 2B and FIGS. 3-5) for engagement with the clip 14. The cabinet latch 146 can be made from the same materials as the bracket 12. The cabinet latch 146 has a rectangular base 148 (FIG. 2B). Two notches 150, 152 are located at either end of the base 148 along opposite sides. The overall size of the cabinet latch 146 is within the range of one-half to one inch long and one-half to one inch wide. Two fasteners 142 (FIGS. 3-5) attach the cabinet latch 146 to the door 144 of the cabinet through the notches 150, 152.

The cabinet latch 146 includes a protrusion 154 (FIG. 2B) extending perpendicularly from approximately the middle of the length of the base 148. The width of the base 148 is equal to the height of the protrusion 154. The protrusion 154 has a linearly extending portion 156 and a hollow, diamond-shaped portion 158 located at the end of the linearly extending portion 156. The diamond-shaped portion 158 is dimensioned to fit inside the diamond-shaped cavity 134 of the first and second arms of the clip 14. The diamond-shaped portion 158 has two outwardly extending arched side portions 160, 162.

In order to prevent the protrusion 154 from bending along the linearly extending portion 156 relative to the base 148, the latch 146 includes two support flanges 164 and 166. The support flanges 164 and 166 are triangular in shape and are formed integrally with the other portions of the latch 146. The support flanges 164 and 166 extend between the base 148 and the portion 156 of the protrusion 154.

Figures 3, 4, 5:
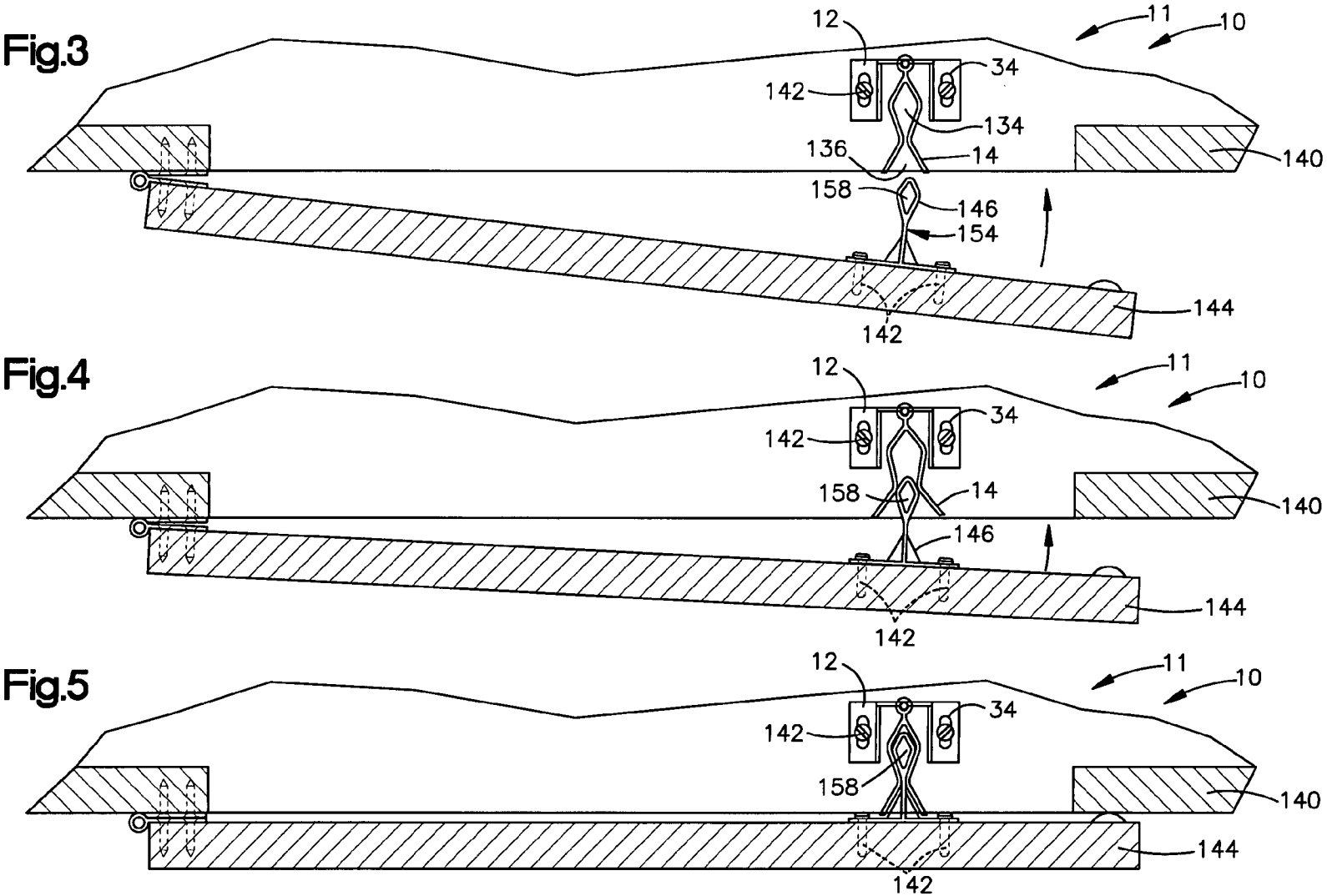
FIG. 3 is a view of a cabinet catch embodying the present invention showing the cabinet catch mounted on a cabinet in a first condition.
FIG. 4 is a view of the cabinet catch embodying the present invention showing the cabinet catch mounted on a cabinet in a second condition.
FIG. 5 is a view of the cabinet catch embodying the present invention showing the cabinet catch mounted on a cabinet in a third condition.

FIGS. 3-5 illustrate three conditions of operation of the cabinet latch assembly 11, shown as fastened to a cabinet structure 140 and a door 144 respectively. FIG. 3 illustrates the cabinet latch 146 and cabinet catch 10 in an initial position in which the cabinet door is not yet closed, that is not yet latched to the cabinet structure 140.

The cabinet catch 10 is mounted to the cabinet (FIGS. 3-5) by mounting the bracket 12 to the cabinet structure 140 with, for example, screws 142 through the slots 34. The bracket 12 is shown in FIGS. 3-5 as being fastened to a bottom wall of the cabinet structure 140. However, the bracket 12 can also be fastened to an internal shelf or to the upper wall of the cabinet structure 140. The elongated slot 34 allows for adjustable mounting of the bracket 12 if for example, the door 144 of the cabinet and the cabinet structure 140 to which the bracket is fastened do not line up exactly. The bracket 12 is fastened onto the cabinet structure 140 so that the opening 136 of the clip 14 faces towards the door 144 of the cabinet. The cabinet latch 146 is fastened to the door 144 of the cabinet at a location approximately opposite the cabinet catch 10.

Engagement of the cabinet catch 10 with the cabinet latch 146 is effected by closing the cabinet door 144 so that the diamond-shaped end portion 158 of the cabinet latch is inserted in the opening 136 of the clip 14. If the catch 10 and the latch 146 are not lined up exactly, force from the latch 146 causes the clip 14 to rotate slightly relative to the bracket 12 about the axis of rotation 20, in the space between the first and second side walls 36 and 48 to line up exactly with the latch 146.

The diamond-shaped end portion 158 of the cabinet latch 146 enters the opening 136 in the clip 14 and engages the arms 90 and 92 of the clip. The force exerted by the latch 146 on the arms 90 and 92 is greater than the predetermined force. The arms 90 and 92 separate, allowing the end portion 158 of the latch 146 to enter the cavity 134 (FIG. 4).

After the end portion 158 of the cabinet latch 146 is completely inside the cavity 134, the first and second arms 90, 92 resiliently return to the initial or free position (FIG. 5). Depending on manufacturing tolerances, the second end points 138 of the first and second arms 90, 92 of the clip 14 may or may not contact the base 148 of the latch 146. In addition, the third inner surface portions 124 of the first and second arms 90, 92 of the clip 14 may or may not contact the third side 172 of the support flanges 164, 166 of the latch 146.

The cabinet latch assembly 11 holds the door 144 of the cabinet closed onto the cabinet structure 140 until it is desirable to open the cabinet door. When the cabinet door 144 is opened, the end portion 158 of the cabinet latch 146 is pulled outward from the catch 10, with a force that exceeds the predetermined force. The force from the latch 146 spreads the first and second arms 90, 92 of the clip 14 outward away from each other, allowing the latch to be removed from the catch through the opening 136.

The cabinet catch 10 is made by an in mold assembly technique known as two-shot injection mold technology. The clip 14 and the bracket 12 of the cabinet catch 10 are integrally molded by this technique.

Figure 6:
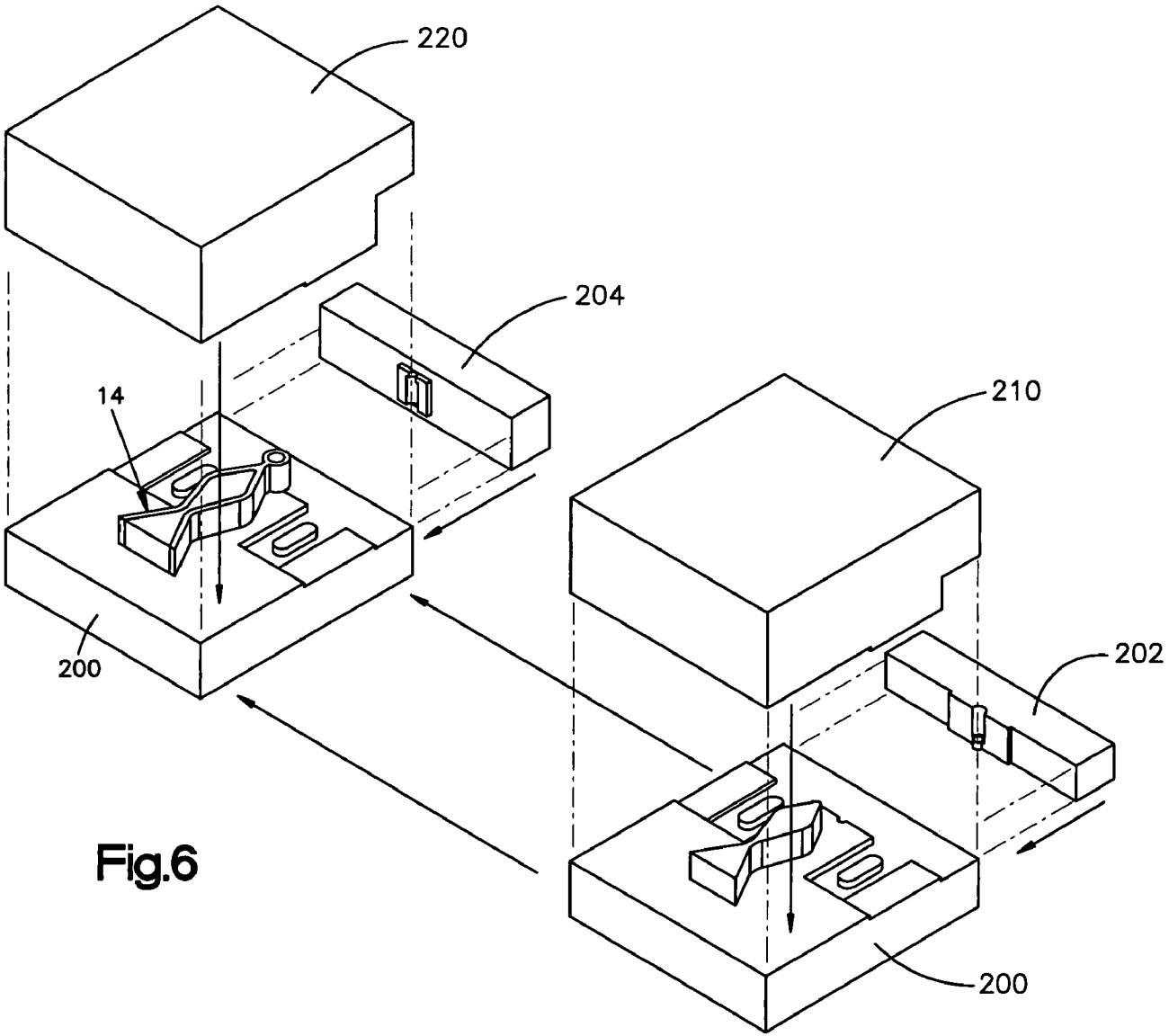
FIG. 6 is a perspective view of the method of molding the cabinet catch embodying the present invention.
Figure 7A:
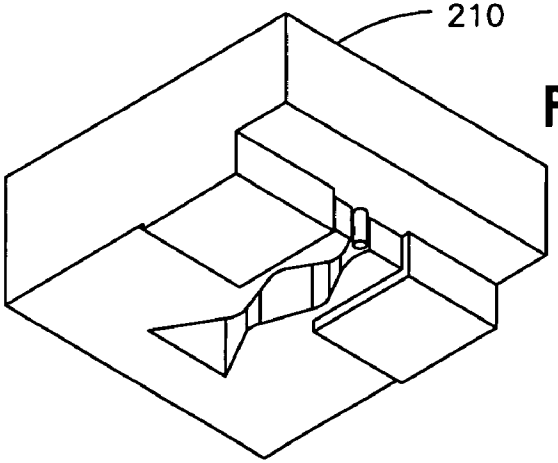
FIG. 7*a* is a perspective view of the underside of the second mold part of FIG. 7.
Figure 7B:
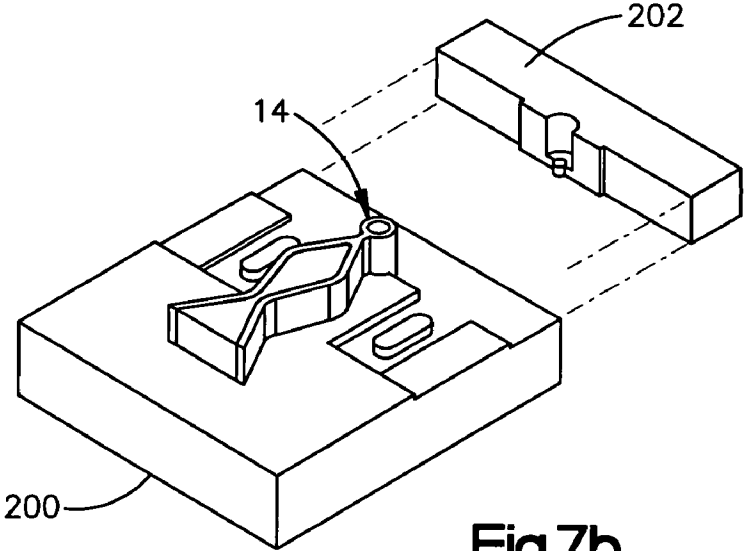
FIG. 7*b* is a perspective view of the first mold part of FIG. 7 with the clip molded.
Figure 7:
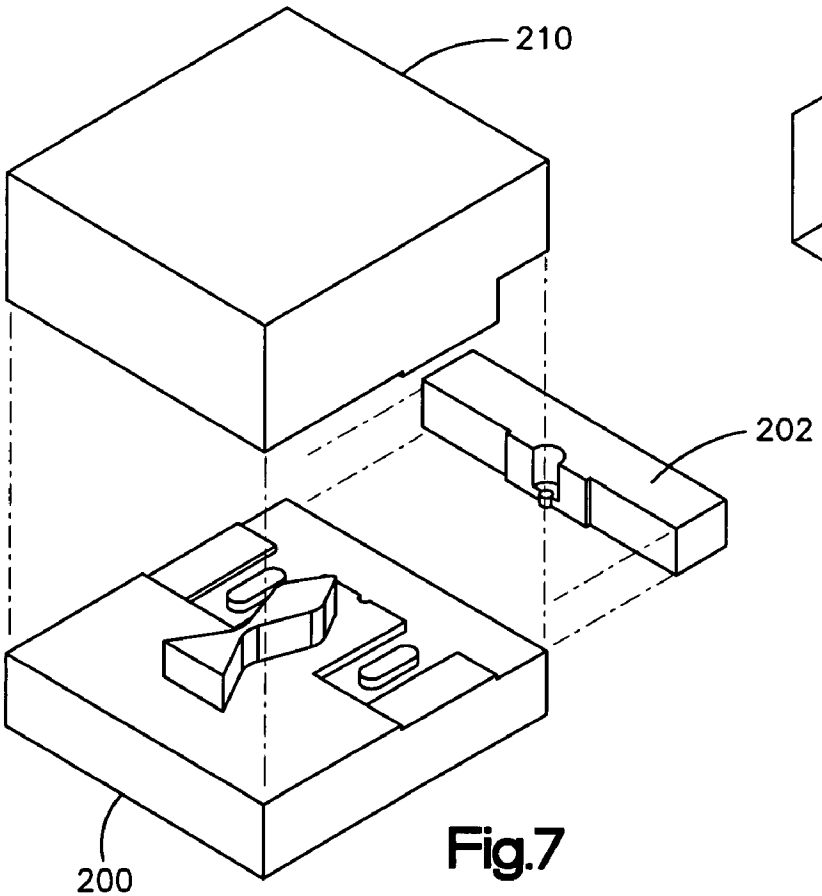
FIG. 7 is a perspective view of the first and second mold parts for molding the clip portion of the cabinet catch embodying the present invention.

The clip 14 is injection molded first (FIGS. 6-7*b*). A movable first mold part 200 contains the mold for molding the clip 14 and the first half of the bracket 12. The movable first mold part 200 (FIG. 6) includes two interchangeable slides 202, 204. The first slide 202 is used to mold the clip 14. The second slide 204 is used to mold the bracket 12.

Figure 8A:
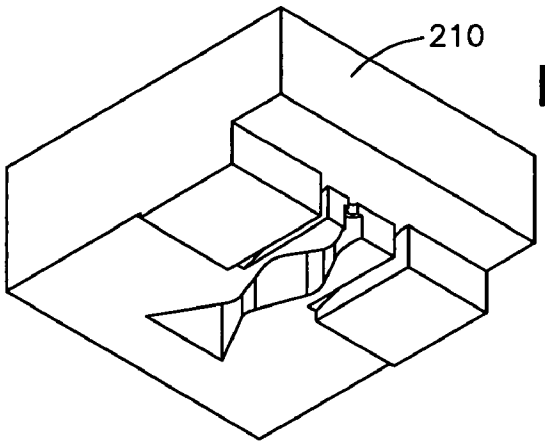
FIG. 8*a* is a perspective view of the underside of the third mold part of FIG. 8.
Figure 8B:
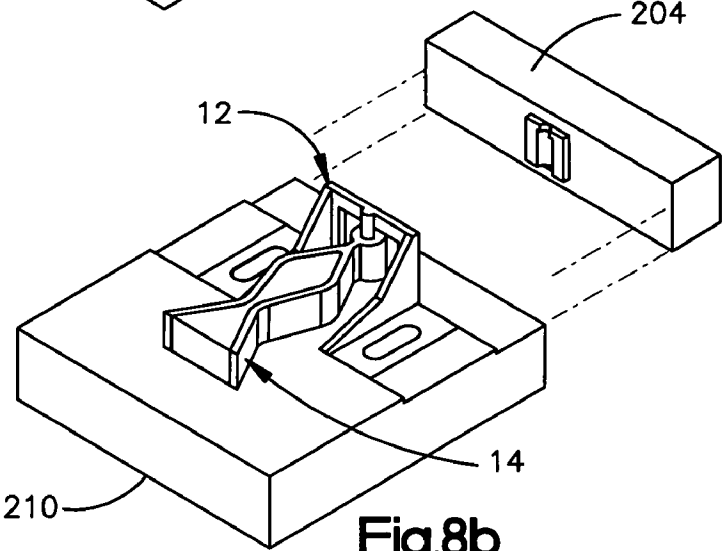
FIG. 8*b* is a perspective view of the first mold part of FIG. 8 shown with clip and the bracket integrally molded together.
Figure 8:
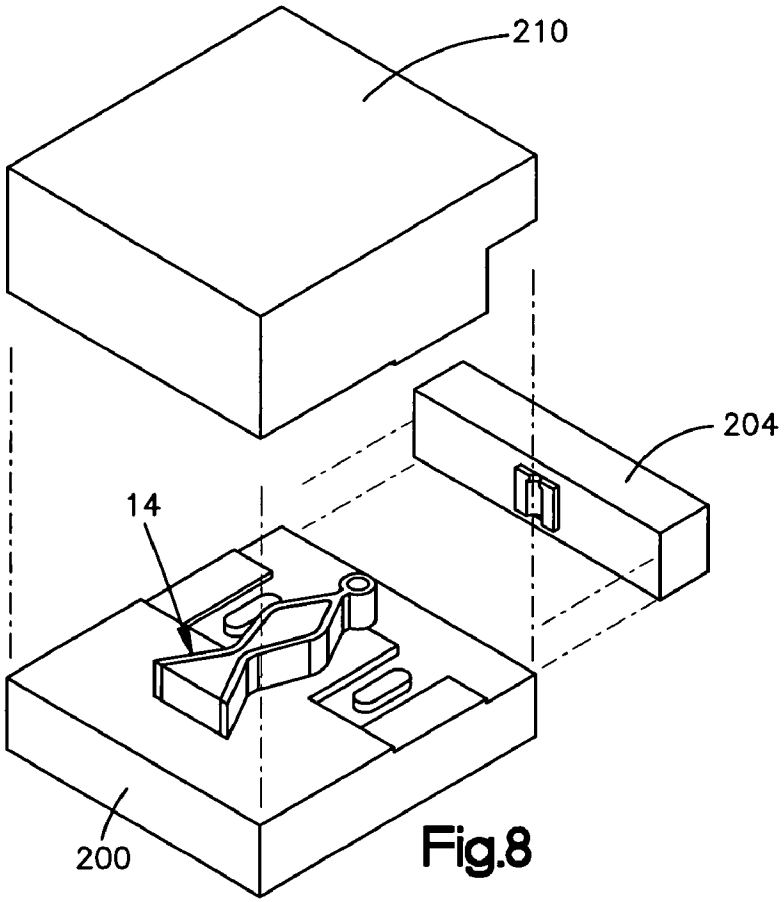
FIG. 8 is a perspective view of the first and third mold parts for molding the bracket portion of the cabinet catch embodying the present invention.

The first mold part 200 is associated either with a second mold part 210 or a third mold part 220. The second mold part 210 (FIGS. 6-8) contains the mold for molding the second part of the clip 14. The second mold part 210 includes an opening (not shown) for injecting a first plastic molding material for molding the clip 14. The third mold part 220 (FIG. 6) contains the mold for molding the second half of the bracket 12 (FIGS. 8-8*a*). The third mold part 220 includes an opening (not shown) for injecting a second plastic molding material for molding the bracket 12, after the clip 14 is molded.

The clip 14 is injection molded first. The first and second mold parts 200, 210 and the slide 202 are closed together (right half of FIG. 6), and a first plastic molding material is injected into the opening (not shown) in the second mold part 210. The closed first and second mold parts 200, 210 and the slide 202 are subsequently opened (FIG. 7). The cured clip 14 is located on the first mold part 200 (FIG. 7*b* and left half of FIG. 6). The injection molded clip 14 remains on the first mold part 200 as the first mold part is subsequently joined together with the third mold part 220 and the second slide 204 (left half of FIG. 6).

A second plastic molding material is injected into the an opening (not shown) in the third mold part 220. The bracket 12 is integrally molded with the clip 14 by injection molding the solid cylindrical member 68 of the bracket through the hollow cylindrical member 78 of the clip 14. The closed first and third mold parts are subsequently opened (FIG. 8), and the integrally molded clip 14 and bracket 12 is ejected from the first mold part (FIG. 8*b*).

The plastic material used to mold the clip 14 is dissimilar to the plastic material used to mold the bracket 12. The plastic materials used to mold the clip 14 and the bracket 12 have dissimilar properties in that the plastic material of the clip does not adhere to or bond with the plastic material of the bracket during the molding process of forming the integral clip and bracket portions of the catch 10.

Plastic materials have inherent shrinkage properties during molding processes and specifically during when the plastic material cures. During the injection molding process of the present invention, the material of the clip 14 is injection molded first and forms an opening 21 which is predefined by a geometry in mold part 210 and slide 202. The opening 21 defines a boundary into which the plastic material of the bracket is subsequently injected (FIG. 2A). As it cures, the plastic material of the bracket 12 shrinks away from the boundary defined by the opening 21 in the clip 14 to leave a clearance between the clip and the bracket. Due to the clearance, the clip 14 is rotatable relative to the bracket 12.

From the above description of the invention, those skilled in the art will perceive improvements, changes and modifications in the invention. For example, the cabinet catch 10 can be used as an apparatus for releasably securing two structures together in an overlying relationship, and is not necessarily limited to securing cabinet doors to cabinet structures. Such improvements, changes and modifications within the skill of the art are intended to be covered by the appended claims.

Having described the invention, we claim the following:

1. Apparatus for releasably securing two structures together in an overlying relationship, the apparatus comprising:

a molded plastic bracket for mounting to one of the two structures;

a plastic clip integrally formed with the bracket, the clip having first and second flexible arm portions which define a cavity; and a latch for mounting to the other of the two structures, the latch having a protrusion for location in the cavity in the clip, the latch and the catch releasably securing the two structures in an overlying relationship when the protrusion is located in the cavity in the clip, the clip is rotatable relative to the bracket about an axis of rotation, wherein the bracket includes first and second spaced apart legs, first and second side walls and a back wall, the first and second spaced apart legs, the first and second side walls and the back wall having continuous surface portions.

2. The apparatus according to claim 1 wherein the first and second spaced apart legs extend in a direction perpendicular to the axis of rotation, and wherein the first side wall extends perpendicularly from the first leg in a direction parallel to the axis of rotation and the second side wall extends perpendicularly from the second leg in a direction parallel to the axis of rotation.

3. The apparatus according to claim 1 wherein said bracket includes a member, said clip including a head portion that surrounds said member to allow rotation of the clip relative to the bracket about the axis of rotation.

4. The apparatus according to claim 3 wherein said clip is permanently formed with said bracket.

5. The apparatus according to claim 1 wherein said clip is permanently formed with said bracket.

6. The apparatus according to claim 1 wherein said clip and said bracket have a molded connection.

7. The apparatus according to claim 1 wherein said clip includes a generally cylindrical opening into which a member of said bracket extends.

8. Apparatus for releasably securing two structures together in an overlying relationship, the apparatus comprising:

a molded plastic bracket for mounting to one of the two structures;

a plastic clip integrally formed with the bracket, the clip having first and second flexible arm portions which define a cavity; and a latch for mounting to the other of the two structures, the latch having a protrusion for location in the cavity in the clip, the latch and the catch releasably securing the two structures in an overlying relationship when the protrusion is located in the cavity in the clip, the clip is rotatable relative to the bracket about an axis of rotation, wherein the bracket includes first and second spaced apart legs, first and second side walls and a back wall, the first and second spaced apart legs, the first and second side walls and the back wall having continuous surface portions, the back wall interconnecting the first and second side walls and extending in a direction parallel to the axis of rotation, the back wall comprising a hollow frame having interconnecting first and second side borders, a top border, a bottom border, and an integrally formed solid cylindrical body interconnecting the top and bottom borders.

* * * * *